US005447228A

United States Patent [19]

Hodgson, III

[11] Patent Number: 5,447,228

[45] Date of Patent: Sep. 5, 1995

[54] GOLF BAG FOR CORRECT CLUB PRESENTATION WHEN BAG IS CART SUPPORTED

[76] Inventor: Morton S. Hodgson, III, 31 Wagon Wheel Ct., Marietta, Ga. 30067

[21] Appl. No.: 160,901

[22] Filed: Dec. 3, 1993

[51] Int. Cl.[6] ..... A63B 55/00

[52] U.S. Cl. ..... 206/315.3; 206/315.6

[58] Field of Search ..... 206/315.3, 315.4, 315.5, 206/315.6, 315.7, 315.8, 315.2

[56] References Cited

U.S. PATENT DOCUMENTS

| | | | |
|---|---|---|---|
| 1,092,729 | 4/1914 | Low et al. | 206/315.6 X |
| 1,788,478 | 1/1931 | Beaty et al. | 206/315.6 |
| 1,798,638 | 3/1931 | Stone et al. | 206/315.6 |
| 2,256,521 | 9/1941 | Kirkpatrick et al. | 206/315.3 |
| 2,325,474 | 7/1943 | Cart | 206/315.7 |
| 2,471,169 | 5/1949 | Salzberg et al. | 206/315.4 |
| 2,546,416 | 3/1951 | Alter et al. | 206/315.6 |
| 4,249,586 | 2/1981 | Setani | 206/315.3 |
| 4,911,292 | 3/1990 | Airey, Jr. | 206/315.3 |
| 5,042,704 | 8/1991 | Izzo | 224/209 |
| 5,099,990 | 3/1992 | Antonious | 206/315.6 |
| 5,123,531 | 6/1992 | Beretta | 206/315.3 |
| 5,148,915 | 9/1992 | Ryan | 206/315.6 |
| 5,188,243 | 2/1993 | Ruiz | 206/315.3 X |
| 5,215,194 | 6/1993 | Blanford et al. | 206/315.3 |

FOREIGN PATENT DOCUMENTS

| | | | |
|---|---|---|---|
| 2669234 | 5/1992 | France | 206/315.3 |
| 1479 | of 1905 | United Kingdom | 206/315.5 |
| 705115 | 3/1954 | United Kingdom | 206/315.5 |
| 2130102 | 5/1984 | United Kingdom | 206/315.6 |

*Primary Examiner*—Sue A. Weaver
*Attorney, Agent, or Firm*—Jacboson, Price, Holman & Stern

[57] ABSTRACT

An upstanding open top golf bag is provided including an upper end collar and a bottom wall. A rigid, lightweight and tubular liner is downwardly telescoped into the bag and angularly displaceable relative thereto about an upstanding axis and the liner includes a lower wall downwardly abutted against the bottom wall of the bag as well as an upper end diametrically enlarged collar downwardly abutted against the collar at the upper end of the bag. The liner collar includes an upper edge at one side thereof which is considerably lower than the diametrically opposite higher upper edge thereof and the liner includes partition structure dividing the interior of the liner into a plurality of compartments including one compartment disposed immediately inward of the lower upper edge and another compartment immediately inward of the higher upper edge of the liner collar. Furthermore, the liner is angularly displaceable about an upstanding axis relative to the bag between a first position with the lower upper edge disposed at the side of the bag from which a carrying handle and shoulder strap are supported and a second position with the higher upper edge of the liner collar disposed at the last mentioned side of the bag, the bag and liner including coacting anchor structure releasably anchoring the liner within the bag against angular displacement relative to the bag from either of the aforementioned first and second positions.

7 Claims, 1 Drawing Sheet

GOLF BAG FOR CORRECT CLUB PRESENTATION WHEN BAG IS CART SUPPORTED

BACKGROUND OF THE INVENTION

1. Field of the Invention

This invention relates to a golf bag including a partitioned liner telescoped and rotatably received therein for maintaining a plurality of golf clubs within a plurality of segregated areas within the liner and with the liner projecting above the open top of the bag and equipped with one side thereof lower than the remainder of the bag, the liner being upwardly removable supported from the bag for alternate 180° angular positioning therein and with the bag and liner provided with coacting releasably engageable retaining structure whereby the liner may be releasably retained within the bag in either 180° rotated positions thereof.

2. Description of Related Art

Various different forms of golf bags including some of the general structural and operational features of the instant invention are disclosed in U.S. Pat. Nos. 4,249,586, 5,042,704, 5,123,531 and 5,215,194. However, these previously known forms of golf bags do not include the overall combination of structural and operational features of the instant invention which adapt the instant golf bag not only to be carried by a caddy but also to be mounted on the back of a golf cart and with the clubs within the bag presented for easy selection by a golfer, whether the bag has been carried by a caddy or on the back of a golf cart.

SUMMARY OF THE INVENTION

Conventional golf bags include a carrying handle closely below the top collar of the bag on one side thereof and the bag further includes a shoulder strap on the same side of the bag with one end of the shoulder strap attached to the bag below the carrying handle and the other end of the shoulder strap anchored relative to the top collar. Furthermore, the top collar, on the side thereof remote from the handle and the shoulder strap, is lower than the side of the collar corresponding to the bag side from which the carrying handle and shoulder strap are supported. The interior of the bag is partitioned to receive the putter and shorter irons 8 and 9 as well as the wedges immediately adjacent the lower collar side, the longer irons 2–7 in the center of the bag and the three woods in the side of the bag corresponding to the side thereof from which the carrying handle and shoulder strap are supported. This allows a caddy to remove the bag from his or her shoulder and to present the bag to the golfer with the putter and shorter irons 8 and 9 as well as the wedges on the side of the bag adjacent the golfer and the taller woods on the side of the bag remote from the golfer.

However, when the same golfer wishes not to use a caddy, but instead to use a golf cart, golf carts are constructed with a rear platform thereon for receiving golf bags and a rear strap for passage through the carrying handle of the bag behind the latter. Accordingly, when a golfer approaches the golf cart from the rear to reach for a club, the woods are in the side of the bag adjacent the golfer and the shorter putter and irons 8 and 9 as well as the wedges are on the side of the bag remote from the golfer, thus repairing the golfer to reach over the taller woods in order to obtain his or her putter and the various irons contained within the bag.

Accordingly, a need exists for means by which a golf bag may have at least the top collar thereof supported from the bag in 180° relatively rotated positions so as to adapt the bag for convenience on the part of the golfer both when the bag is carried by a caddy and when the bag is carried on a golf cart.

To this end, the top collar of the bag of the instant invention is carried by a removable insert which may be secured within the bag in 180° relatively rotated positions and wherein one side of the collar is lower than the remainder of the collar. The insert comprises a rigid but lightweight tubular member having the top collar of the bag formed on its upper end as a diametric enlargement of the insert and the insert itself includes a bottom wall abutted against the bottom of the bag and the underside of the diametrically enlarged collar abutted against the upper end of the outer bag. In this manner, the weight of the clubs supported within the bag is carried by the insert and the combined weight of the insert and the clubs therein is distributed not only to the bottom of the exterior bag but also to the top of the exterior bag. Further, the exterior bag may be constructed of durable but lightweight material without concern for damage to the clubs within the bag inasmuch as the clubs themselves are supported within a lightweight but rigid liner or insert within the bag.

Furthermore, inasmuch as the liner may be rotated between 180° relatively rotated positions within the bag, the bag is adaptable for use by a golfer when his bag is being carried by a caddy and also when his bag is supported on the back of a golf cart.

Still further, the insert and outer bag include coacting fastening structure for releasably securing the liner within the bag and also in each of its 180° relative rotated positions relative to the bag.

The main object of this invention is to provide a golf bag which may be readily transformed from a bag adapted to be carried by a caddy and a bag adapted to be supported on the rear of a golf cart.

Another object of this invention is to provide an improved golf bag which may utilize durable and lightweight material for the exterior of the bag as well as a lightweight and rigid liner for the bag for actually supporting the associated golf clubs, thereby providing a lighter weight bag without sacrifice of strength of the bag to the extent that damage may be done to the clubs contained within the bag.

Still another important object of this invention is to provide a golf bag in accordance with the preceding objects and which will otherwise be substantially identical in construction and operation to conventional golf bags presently being marketed.

A final object of this invention to be specifically enumerated herein is to provide a golf bag in accordance with the preceding objects and which will conform to conventional forms of manufacture, be of simple construction and easy to use so as to provide a device that will be economically feasible, long lasting and relatively trouble free in operation.

These together with other objects and advantages which will become subsequentially apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
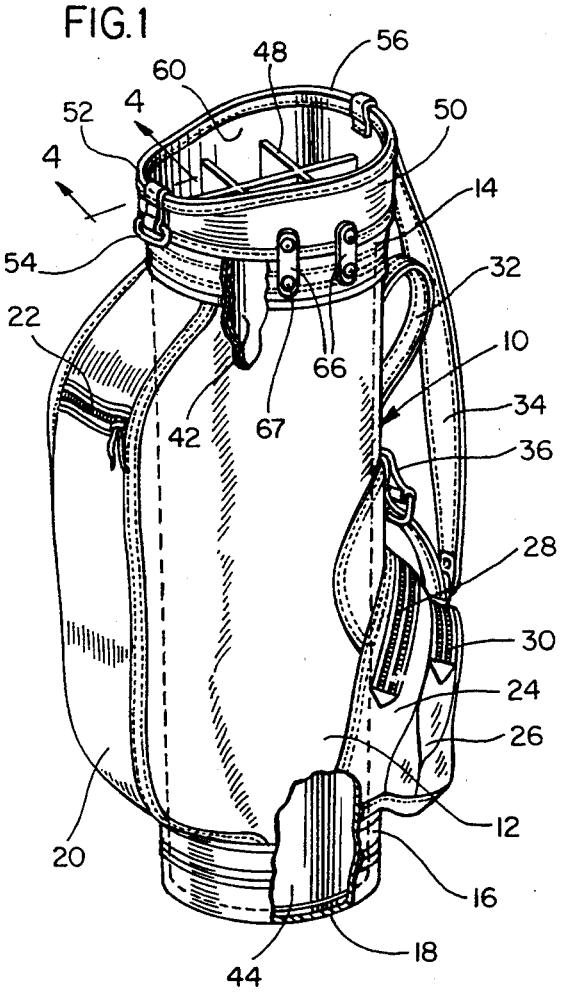
FIG. 1 is a perspective view of a golf bag constructed in accordance with the present invention and with upper and lower portions of the near side of the outer bag broken away and illustrated in vertical section in order to illustrate the underlying portions of the bag liner or insert.
Figure 2:
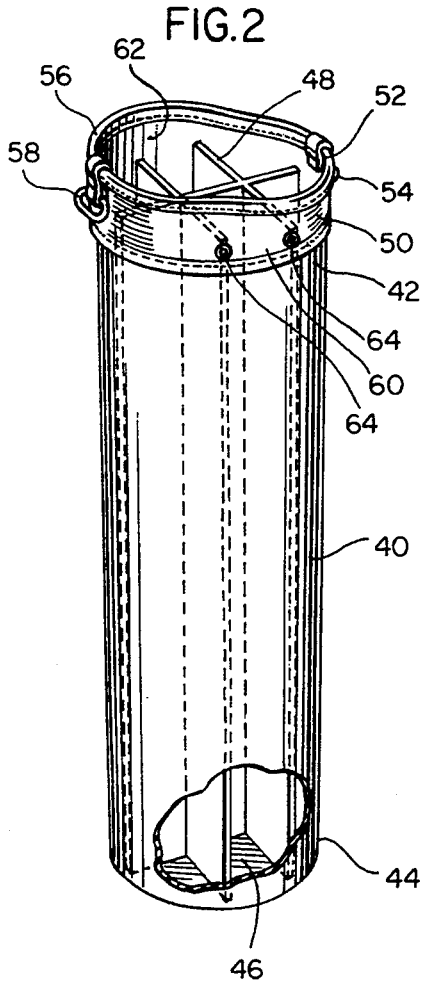
FIG. 2 is a perspective view of the bag insert or liner rotated approximately 180° about its longitudinal vertical axis from the position of the liner illustrated in FIG. 1 and with a lower portion of the near side of the wall of the liner being broken away and illustrated in section.

Referring now more specifically to the drawings the numeral 10 generally designates a golf bag constructed in accordance with the present invention.

The golf bag 10 includes an outer body 12 usually constructed of heavy leather or other durable material and usually provided with an internal stiffener structure (not shown). The body 12 includes substantially rigid top and bottom collars 14 and 16 and the bottom collar 16 includes a bottom wall 18 while the top collar 14 is tubular. Both of the collars are secured over the exterior of the body 12 and one side of the body 12 includes a large outer compartment 20 removably closed by a slide fastener 22 and the opposite side of the body 12 includes second 24 and third 26 compartments which are smaller in size and removably closed by slide fasteners 28 and 30. In addition, the golf bag 10 includes a handle 32 secured to the upper portion of the body 12 on the side thereof remote from the compartment 20 and also a shoulder strap 34 including a first end secured to the bag body 12 below the handle 32 as at 36 and a second end normally secured to the collar 14 above the handle 32.

In addition, a conventional golf bag 10 usually includes a top collar which is slightly elongated relative to the collar 14 and has the upper end or top edge of the side thereof remote from the shoulder strap 34 lower than the remainder of the collar 14, at least the collar 14 including partitions therein dividing the upper portion of the interior of the golf bag 10 into at least three separate compartments including (1) a first compartment on the side of the golf bag 10 from which the compartment 20 is supported for containing the putter and shorter irons 8 and 9 as well as the wedges, (2) a second compartment adjacent the opposite side of the bag for containing the woods and (3) a center compartment for containing irons 2–7, for example. In this manner, the putter and shorter irons 8 and 9 as well as the wedges are supported at the side of the bag with the lower top edge and the taller woods are supported at the opposite side of the bags.

The golf bag of the instant invention, however, includes a lightweight body as well as a rigid, lightweight tubular liner 40 having upper and lower ends 42 and 44. The upper end 42 is open and the lower end is closed by a lower wall 46. In addition, the liner includes inner partition structure 48 and an upper diametrically enlarged outer collar 50, the collar including a low side or top edge 52.

The upper end of the body 12 and the interior of the collar 14 supported therefrom are circular in plan shape, as is the exterior of the liner 40 and the collar 50. The liner 40 is snugly downwardly telescoped within the open upper end of the body 12 from which the collar 14 is supported to a lower limit position with the lower wall 46 abutted against the bottom wall 18 and the lower end of the collar 50 downwardly abutted against the upper end of the collar 14. Further, the center of the low side 52 of the collar 50 includes an anchor ring 54 supported therefrom and the opposite high side 56 of the collar 50 includes a second anchor ring 58 supported therefrom, the upper end of the shoulder strap 34 in FIG. 1 being releasably secured to the anchor ring 58 of the collar 50.

Figure 4:
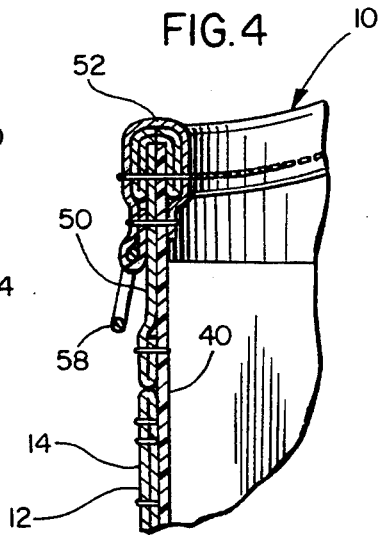
FIG. 4 is an enlarged fragmentary vertical sectional view taken substantially upon the plane indicated by the section line 4—4 of FIG. 1.

The diametrically opposite low and high sides 52 and 56 are disposed on a first diameter of the collar 50 and the collar 50 includes a second pair of opposite sides 60 and 62 disposed on a second diameter of the collar 50 normal to the first mentioned diameter and the opposite sides 60 and 62 each include a pair of circumferentially spaced male snap members 64 centrally supported therefrom. Further, identical male snap members (not shown) are carried by the corresponding opposite sides of the collar 14 and elongated attaching straps 66, whose opposite ends are equipped with female snap members 67, are secured between the male snap members carried by the collars 14 and 50 to releasably retain the liner 40 within the body 12 with the lower wall 46 of the liner 40 abutted against the bottom wall 18 and the lower end of the collar 50 abutted downwardly against the top end of the collar 14, see FIG. 4.

Figure 3:
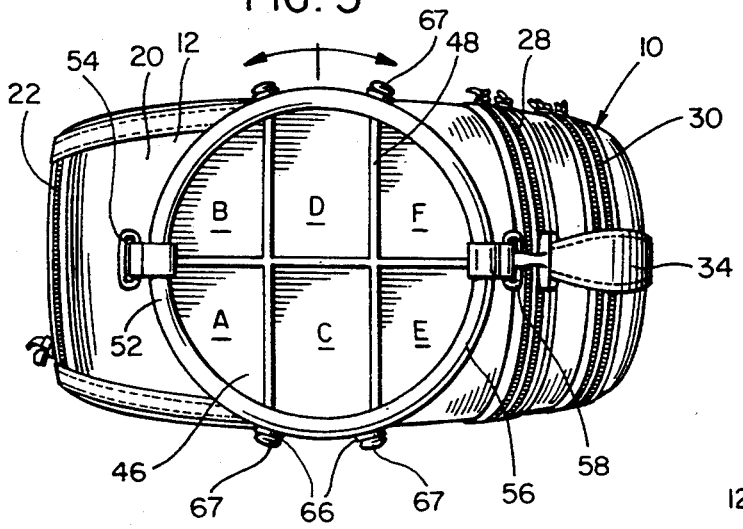
FIG. 3 is an enlarged top plan view of the bag.

If it is desired to have a caddy carry the golf bag 10, the liner 40 is secured within the body 12 through the utilization of the straps 66 with the liner 40 in the position thereof illustrated in FIG. 1 and the upper end of the shoulder strap 34 anchored to the anchor ring 58. In this manner, the putter and irons 1–3 may be contained in the compartments A and B defined by the partition structure 48 as illustrated in FIG. 3, irons 4–8 may be contained in the compartments C and D as shown in FIG. 3 and the woods may be contained in the compartments E and F as defined by the partition structure 48 in FIG. 3. Therefore, when the golf bag 10 is removed from the shoulder of a caddy and presented on the ground to the golfer, the shorter clubs comprising the putter and shorter irons 8 and 9 as well as the wedges will be closest to the golfer, the longer irons 2–7 will be in the middle and the longest woods will be disposed furtherest from the golfer.

However, when it is desired to support the golf bag 10 from the rear of a golf cart, the golf bag 10 is placed upon the rear platform of the golf cart and the retaining strap is extended through the handle 32 behind the body 12. This places the taller drivers in the front of the bag (as approached by a golfer) and the putter and shorter irons 8 and 9 as well as the wedges in the rear of the bag. Accordingly, when the golf bag 10 is to be mounted upon the rear of a golf cart, the straps 66 have either their upper or lower ends disengaged from the male snap members 64 on the collar 50 or the collar 14, respectively, the liner is rotated 180° about its vertical longitudinal axis relative to the body 12 and the straps 66 are refastened. Accordingly, the putter and shorter irons 8 and 9 as well as the wedges will be disposed in the front of the bag (as approached by the golfer) and the taller woods will be disposed in the rear of the bag. Of course, after the straps 66 have been disconnected, the upper end of the shoulder strap 34 is disengaged from the anchor ring 52 on the high side 56 of the collar 50 and the upper end of the shoulder strap 34 is reattached to the anchor ring 54 on the low side 52 of the collar 50 after the liner 40 has been rotated 180° relative to the bag 12 to its new position.

Accordingly, the golf bag 10 adapted to be carried by a caddy when the liner 40 is rotated to the position thereof illustrated in FIG. 1 with the high side 56 of the collar 50 disposed at the side of the body 12 from which the handle 32 is supported and with the upper end of the shoulder strap 34 releasably anchored to the anchor ring 58. On the other hand, should it be desired to support the golf bag 10 from the rear of a golf cart, the straps 66 on both sides of the body 12 are disconnected, the upper end of the shoulder strap 34 is released from engagement with the anchor ring 52, the liner 40 is rotated 180° relative to the body 12, the straps 66 are reattached and the upper end of the shoulder strap 34 is releasably anchored to the anchor ring 54. Therefore, it may be seen that the golf bag 10 may be readily transformed from one usage thereof to the other in approximately twenty seconds or less. Furthermore, the body 12 of the golf bag 10 does not need to be provided with any internal reinforcement in order to protect the golf clubs to be disposed therein, inasmuch as the liner 40 (which is rigid and of lightweight construction) provides internal reinforcement for the bag 12 and protection to the supported clubs, all of which results in a lightweight golf bag which offers substantially maximum protection to the clubs supported therein and yet may be readily transformed from a caddy carried golf bag to a golf cart carried golf bag and vice versa with little effort and in a very short period of time.

The foregoing is considered as illustrative only of the principles of the invention. Further, since numerous modifications and changes readily will occur to those skilled in the art, it is not desired to limit the invention to the exact construction and operation shown and described, and accordingly, all suitable modifications and equivalents may be resorted to, falling within the scope of the invention.

What is claimed as new and is follows:

1. A golf bag including an upright tubular outer body having upper and lower ends and a bottom wall closing said lower end, said upper end being open, an inner upright tubular liner having upper and lower ends with the upper end of said liner being open and the lower end of said liner being closed by a lower wall, said liner being removably downwardly telescoped within said outer body to a limit position with the upper end of said liner projecting upwardly outwardly of said body upper end, said liner including partition means therein operative to maintain at least the upper end portions of a plurality of inverted golf club shafts telescoped downwardly into said liner in a plurality of segregated areas within said liner upper end and with two of said segregated areas being disposed at opposite sides of the interior of said liner, said inner liner and outer body including releasably engageable coacting anchor means releasably retaining said inner liner within said outer body against removal therefrom, said inner body being downwardly receivable within said outer body with said inner liner rotated in either of two 180° rotated positions relative to said body to thereby reverse the positions of said two segregated areas relative to a first side of said outer body, said coacting anchor means including means operable to relasably retain said inner liner within said outer body with said inner liner disposed in either of said two 180° rotated positions relative to said body, said upper end of said liner including a first side thereof which is appreciably lower than a second side thereof opposite said first side, said first liner side comprising one of said opposite sides.

2. The golf bag of claim 1 wherein said lower wall is downwardly abutted against said bottom wall to define said limit position.

3. A golf bag including an upright tubular outer body having upper and lower ends and a bottom wall closing said lower end, said upper end being open, an inner upright tubular liner having upper and lower ends with the upper end of said liner being open and the lower end of said liner being closed by a lower wall, said liner being removably downwardly telescoped within said outer body to a limit position with the upper end of said liner protecting upwardly outwardly of said body, upper end, said liner including partition means therein operative to maintain at least the upper end portions of a plurality of inverted golf club shafts telescoped downwardly into said inner in a plurality of segregated areas within said liner upper end and with two of said segregated areas being disposed at opposite sides of the interior of said liner, said inner liner and outer body including releasably engageable anchor means releasably retaining said inner liner within said outer body against removal therefrom, said inner body being downwardly receivable Within said outer body with said inner liner rotated in either of two 180° rotated positions relative to said body to thereby reverse the positions of said two segregated are relative to a first side of said outer body, said coacting anchor means including means operable to releasably retain said inner liner within said outer body with said inner liner disposed in either of said two 180° rotated positions relative to said body, upper end of said liner including a diametrically enlarged collar downwardly abutted against the upper end of said outer body to define said limit position.

4. The golf bag of claim 3 wherein said lower wall is downwardly abutted against said bottom wall to also define said limit position.

5. A golf bag including an upright tubular outer body having upper and lower ends and a bottom wall closing said lower end, said upper end being open, an inner upright tubular liner having upper and lower ends with the upper end of said liner being open and the lower end of said liner being closed by a lower wall, said liner being removably downwardly telescoped within said outer body to a limit position with the upper end of said liner projecting upwardly outwardly of said body upper end, said liner including partition means therein operative to maintain at least the upper end portions of a plurality of inverted golf club shafts telescoped downwardly into said liner in a plurality of segregated areas within said liner upper end and with two of said segregated areas being disposed at opposite sides of the interior of said liner, said inner liner and outer body including releasably engageable coacting anchor means releasably retaining said inner liner within said outer body against removal therefrom, said inner body being downwardly receivable within said outer body with said inner liner rotated either of two 180° rotated positions relative to said body to thereby reverse the positions of said two segregated areas relative to a first side of said outer body, said coacting anchor means including means operable to releasably retain said inner liner within said outer body with said inner liner disposed in either of said two 180° rotated positions relative to said body, said first and second opposite sides of the upper end of said liner including selectively usable first and second shoulder strap anchor means, respectively, said first side of said body including third shoulder strap anchor means, an elongated shoulder strap having opposite ends, a first end of said shoulder strap being anchored relative to said third shoulder strap anchor means, the second end of said shoulder strap being removably anchorable to either of said first and second anchor means.

6. The combination of claim 5 wherein said upper end of said liner includes a first side thereof which is appreciably lower than a second side thereof opposite said first side, said first liner side comprising one of said opposite sides.

7. The combination of claim 6 wherein said upper end of said liner includes a diametrically enlarged collar downwardly abutted against the upper end of said outer body and said lower wall is downwardly abutted against said bottom wall to define said limit position.

* * * * *